US005992381A

United States Patent [19]

Aubourg

[11] Patent Number: 5,992,381

[45] Date of Patent: Nov. 30, 1999

[54] PROCESS FOR DETERMINING THE OPTIMAL RICHNESS OF A FUEL-AIR MIXTURE SUPPLIED TO AN INTERNAL COMBUSTION ENGINE AND CORRESPONDING DEVICE

[75] Inventor: Alain Aubourg, Saint-Jean, France

[73] Assignee: Siemens Automotive S.A., Toulouse Cedex, France

[21] Appl. No.: 09/049,565

[22] Filed: Mar. 27, 1998

Related U.S. Application Data

[63] Continuation of application No. PCT/EP96/03516, Aug. 8, 1996.

[30] Foreign Application Priority Data

Sep. 27, 1995 [FR] France ..... 95 11427

[51] Int. Cl.[6] ..... F02M 7/00

[52] U.S. Cl. ..... 123/344; 123/478; 123/436

[58] Field of Search ..... 123/344, 436, 123/478, 480

[56] References Cited

U.S. PATENT DOCUMENTS

| | | | |
|---|---|---|---|
| 4,368,707 | 1/1983 | Leshner et al. . | |
| 4,393,845 | 7/1983 | Seitz . | |
| 4,442,815 | 4/1984 | Ninomiya | 123/480 |
| 4,479,476 | 10/1984 | Suzuki et al. | 123/478 |
| 4,538,578 | 9/1985 | Suzuki et al. | 123/478 |
| 4,864,991 | 9/1989 | Snyder et al. | 123/344 |
| 5,284,113 | 2/1994 | Svensson | 123/344 |

FOREIGN PATENT DOCUMENTS

| | | | |
|---|---|---|---|
| 0 215 411 A2 | 3/1987 | European Pat. Off. . | |
| 4-76240 | 3/1992 | Japan | 123/344 |
| 2 160 999 | 1/1986 | United Kingdom . | |

OTHER PUBLICATIONS

International Publication No. 95/06199 (Svensson et al.), dated Mar. 2, 1995.

*Primary Examiner*—Erick R. Solis
*Attorney, Agent, or Firm*—Herbert L. Lerner; Laurence A. Greenberg

[57] ABSTRACT

A process to determine an optimal richness of a fuel-air mixture supplied to an internal combustion engine. The engine has a speed regulator capable of varying an opening angle of a valve for admitting the fuel-air mixture into the engine to maintain the engine at a constant rotational speed. The process begins by supplying an initial fuel-air mixture to the engine. A rotational speed of the engine is regulated by acting on a position of a valve controlling the admittance of the initial fuel-air mixture and, therefore, the fuel-air mixture affects the rotational speed. A plurality of jumps in the richness of the fuel-air mixture which is supplied to the engine act on the position of the valve. Variations in the position of the valve corresponding to each of the jumps in richness in the initial fuel-air mixture are then measured. It is then deduced that when the variations in the valve position are lower than a threshold that the initial fuel-air mixture is at an optimal richness, and that when the variations in the valve position are higher than the threshold that the richness of the initial air-fuel mixture must be modified. A correction of the richness of the initial fuel-air mixture supplied to the engine is performed if the threshold is exceeded. In addition, the correction step takes into account an amplitude of the measured variations in the valve position.

11 Claims, 1 Drawing Sheet

Fig.1
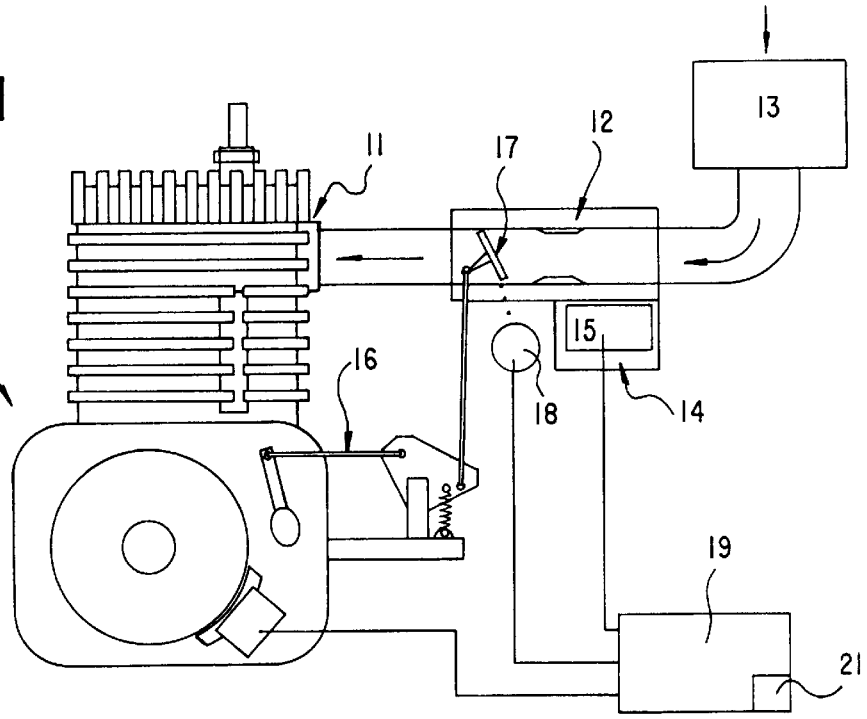
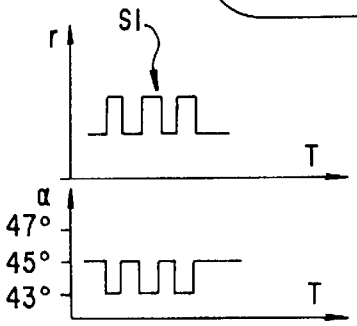
Fig.2
Fig.3
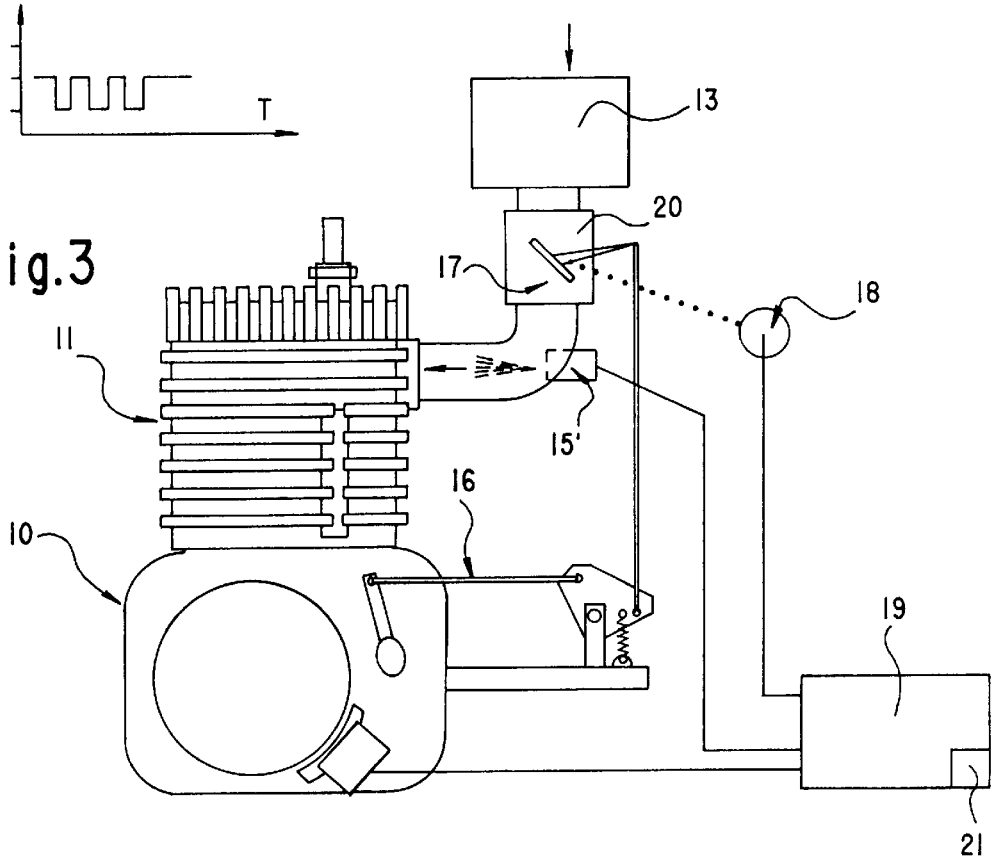

PROCESS FOR DETERMINING THE OPTIMAL RICHNESS OF A FUEL-AIR MIXTURE SUPPLIED TO AN INTERNAL COMBUSTION ENGINE AND CORRESPONDING DEVICE

CROSS-REFERENCE TO RELATED APPLICATION

This application is a continuation of International Application Serial No. PCT/EP96/03516, filed Aug. 8, 1996, which designated the United States.

BACKGROUND OF THE INVENTION

Field of the Invention

The present invention relates to a process for determining the optimal richness of a fuel-air mixture supplied to an internal combustion engine and a corresponding device. More particularly, this device is intended for use with engines of the type used in pumps, generator sets, lawn mowers, etc.

Engines of the above-mentioned type generally run at a constant speed, regardless of the load on the engine. Their carburetion system must therefore supply them with appropriate amounts of air and fuel, no matter what the load is on the engine.

Due to environmental concerns, it has become necessary to impose pollution emission standards for these small internal combustion engines, as is already the case for automobile engines.

In order to reduce the pollution from an engine, it is imperative to burn the fuel as completely as possible during the combustion phase of the fuel mixture. It is therefore advantageous to determine the optimal fuel and air mixture (that is, the optimal richness of the mixture), thus allowing complete combustion. When the engine is thus supplied with a mixture having the optimal richness, it is noted that the torque delivered by the engine is also optimal, as is the rotational speed of the engine. To verify that an engine is operating at the optimal richness, one need only determine the fuel-air mixture that provides the maximal rotational speed of the engine.

Unfortunately in the case of lawn mowers, generator sets, etc., the engine is equipped with a speed regulator in order to have a constant rotational speed. For engines of this type which have a speed regulator, the monitoring of the engine speed is not indicative of the torque and the optimal richness. Therefore, the monitoring of another engine parameter is necessary. However, this monitoring must use the lowest possible number of sensors in order not to increase the cost of the engine.

SUMMARY OF THE INVENTION

It is accordingly an object of the invention to provide a process for determining the optimal richness of a fuel-air mixture supplied to an internal combustion engine and corresponding device, which overcomes the above-mentioned disadvantages of the prior art devices and methods of this general type, and which varies the richness of a mixture supplied to an internal combustion engine equipped with a speed regulator, in a simple and economic way, using the lowest possible number of additional sensors to determine the optimal richness for the engine.

With the foregoing and other objects in view there is provided, in accordance with the invention, a process for determining an optimal richness of a fuel-air mixture supplied to an internal combustion engine, which includes providing an internal combustion engine which has a speed regulator capable of varying an opening angle of a valve which admits the fuel-air mixture into the internal combustion engine to maintain the internal combustion engine at a constant rotational speed; supplying an initial fuel-air mixture to the internal combustion engine; regulating a rotational speed of the internal combustion engine by acting on a position of the valve which controls the admittance of the initial fuel-air mixture by producing a plurality of jumps in the richness in the initial fuel-air mixture supplied to the internal combustion engine for acting on the position of the valve; measuring variations in the position of the valve corresponding to each of the jumps in richness in the initial fuel-air mixture; deducing that when the variations in the position of the valve are lower than a threshold that the initial fuel-air mixture is at an optimal richness, and that when the variations in the position of the valve are higher than the threshold that the richness of the initial air-fuel mixture must be modified; and performing a correction to the richness of the initial fuel-air mixture supplied to the engine if the threshold is exceeded which takes into account an amplitude of the measured variations in the position of the valve.

The advantage of a process of this type resides in the fact that the monitoring of the valve position is easy to achieve using an inexpensive sensor. Moreover, the fact that the amplitude of the variations in the valve position is taken into account makes it possible to quickly determine the optimal richness for the engine in question. The faster this determination is made, the less pollution the engine produces at start-up.

The determination of the optimal richness is made at least at each start-up, and is then applied throughout the duration of the operation of the engine. This determination can also be made after each significant variation of the resisting torque of the engine.

Advantageously, since the optimal richness is determined at each start-up, the wear on the engine, the composition of the fuel, etc., are continually taken into account.

In accordance with an added feature of the invention, there is the step of producing the plurality of jumps in the richness by injecting quantities of fuel different from initial quantities supplied to the internal combustion engine.

In accordance with another feature of the invention, there is the step of producing the plurality of jumps in the richness by injecting quantities of air different from initial quantities supplied to the internal combustion engine.

In accordance with an additional feature of the invention, there is the step of producing three consecutive jumps in the richness, and averaging the measured variations in the position of the valve during the three jumps to determine a correction of the richness to be applied.

In accordance with a further added feature of the invention, there is the step of providing a first table containing the correction to be applied to the initial fuel-air mixture if the initial fuel-air mixture is too lean for each average value of the valve opening angle and for each variation in an opening angle, and providing a second table for containing the correction to be applied to the initial fuel-air mixture when the initial fuel-air mixture is too rich for each average value of the valve opening angle and for each variation in the opening angle.

In accordance with yet another feature of the invention, there is the step of providing the first table and the second table in a form of a stored map for each typical engine.

With the foregoing and other objects in view there is also provided, in accordance with the invention, a device for determining an optimal richness of a fuel-air mixture, including: means capable of imposing jumps in richness of an initial fuel-air mixture supplied to an engine which has a valve; means for measuring variations in a valve position of the valve; computing means capable of determining the richness of the initial fuel-air mixture supplied to the engine; and means for determining a correction to be applied to the richness of the initial fuel-air mixture as a function of an initial position of the valve, an amplitude of the measured variations in the valve position and the richness of the initial fuel-air mixture.

In accordance with an added feature of the invention, the means capable of imposing jumps in the richness has a fuel delivery actuator.

In accordance with another feature of the invention, the means for determining the correction to be applied has two maps which provide the correction to be applied as a function of the measured variations in the valve position, respectively when the initial fuel-air mixture is lean and when it is rich.

In accordance with an additional feature of the invention, the means capable of imposing jumps includes an electronic fuel injection system and the correction to be applied is a variation of an injection time for fuel.

With the foregoing and other objects in view there is further provided, in accordance with the invention, a device for determining an optimal richness of a fuel-air mixture, including: a fuel delivery device capable of imposing jumps in richness of an initial fuel-air mixture supplied to an engine having a valve; a sensor for measuring variations in a position of the valve; a computing device capable of determining the richness of the initial fuel-air mixture supplied to the engine; and the computing device has a memory for determining a correction to be applied to the richness of the initial fuel-air mixture as a function of an initial position of the valve, an amplitude of the measured variations in the position of the valve and the richness of the initial fuel-air mixture.

Other features which are considered as characteristic for the invention are set forth in the appended claims.

Although the invention is illustrated and described herein as embodied in a process for determining the optimal richness of a fuel-air mixture supplied to an internal combustion engine and corresponding device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 1 is a diagrammatic view of a device used in conjunction with an engine having a carburetor according to the invention;

FIG. 2 is a graph showing simultaneous variations in a mixture richness and a corresponding position of a valve; and FIG. 3 is a diagrammatic view of the device used in conjunction with the engine equipped with an electronic fuel injection system.

DESCRIPTION OF THE PREFERRED EMBODIMENTS

Referring now to the figures of the drawing in detail and first, particularly, to FIG. 1 thereof, there is shown an engine 10 which has a single cylinder 11 (as is generally the case with the small engines) which receives a fuel-air mixture issuing from a carburetor 12. The carburetor 12, which is a standard type, is supplied with air via an air filter 13, and with fuel from a fuel tank 14 equipped with a fuel delivery actuator 15 which delivers the fuel to the carburetor 12.

The engine 10 is also equipped with a speed regulator 16 of the known type, which compensates for the variations in the rotation speed of the engine by acting on a position of a valve 17 for admitting the mixture.

The engine 10 according to the invention also comprises a sensor 18 capable of determining the position of the valve 17. The sensor 18 is for example a simple potentiometer.

The position sensor 18, the fuel delivery actuator 15 and the engine 10 are also connected to a computer 19, which implements the process for determining the optimal richness according to the present invention.

The optimal richness is determined as described below. First, the engine 10 is started up. For this purpose, the carburetor 12, in a predetermined way, mixes the fuel issuing from the fuel tank 14 supplied by the delivery actuator 15 with the air that has passed through the air filter 13. In a known way, once the engine 10 is running, the speed regulator 16 acts on the position of the valve 17 in order to keep the speed of the engine 10 constant. In effect, varying the opening angle of the valve 17 causes variations in the engine torque and thus variations in the speed. The operation of an engine 10 of this type equipped with a speed regulator 16 is known per se, and will not be described in detail here.

When the engine 10 is running, and preferably a short time after its start-up, the computer 19 produces a plurality of jumps in richness S1 of the air-fuel mixture as shown in FIG. 2. Preferably, three consecutive jumps in richness are produced. In general, the process begins by increasing the richness r of the air-fuel mixture supplied to the engine 10. The position sensor 18 then measures the variations $\alpha$ in the position of the valve 17 caused by the jumps in the richness.

If these jumps in richness have caused a closing of the valve 17 when the engine is running at a constant load (the case represented in FIG. 2, the valve having a 45° opening initially, and a 43° opening during the jump in richness), it represents that the richness of the air-fuel mixture has caused an increase in the rotational speed of the engine 10 and that the speed regulator 16 has imposed a reduction of the rotational speed in order to maintain the engine 10 at a constant speed. The computer 19 concludes from this that the optimal torque of the engine 10 has not been achieved, and that the mixture supplied to the engine 10 is currently too lean. The computer calculates the average of the variations in the valve position during the produced series of jumps in richness. As a function of the valve position, the computer 19 determines the correction to be made to the richness of the mixture so that it will provide the optimum torque.

This correction is carried out by the delivery actuator 15, which acts on the quantity of fuel delivered into the carburetor 12.

Once the correction sequence is completed, the engine 10 is sensed to be running at its optimum torque, and thus at its minimum level of pollution.

A new series of jumps in richness is then actuated by the computer 19. The variations in the position of the valve 17 created by the new series of jumps in richness are very slight. In effect, when the engine 10 is at its optimum torque, the variations in richness do not cause any noticeable variations in speed. Thus, the average of the variations of the valve position during this new series of jumps is less than a minimum variation threshold. In this case, the engine 10 is at its optimal torque and the richness of the mixture is also optimal.

It is understood that the process according to the present invention is repeated as many times as necessary until the optimal richness has been detected.

As soon as this optimal richness is determined, it is applied to the engine 10 throughout the duration of its operation.

To facilitate the work of the computer 19 during the determination of the correction to be applied to the richness of the mixture, maps are produced from a typical engine. These maps provide, as a function of the initial richness of the mixture, the correction to be applied according to the average of the measured variations in the valve position. Thus, a first table is stored in a memory 21 which provides, for each average valve opening angle before the application of any jump in richness, and for each valve position variation after the application of a jump in richness, the value of the correction to be applied to the mixture when the initial mixture is too lean, and likewise, a second table is stored which provides the value of the correction to be applied to the mixture when the initial mixture is too rich.

In effect, when the initial mixture is too rich, the correction to be applied is a reduction in the quantity of fuel delivered to the carburetor 12, and when the initial mixture is too lean, an increase in the quantity of fuel to be injected must be implemented.

In the example given above and as shown in FIG. 2, the initial mixture was too lean, since it caused a closing of the valve 17. Of course, in the case of an initial mixture that is too rich, the opposite occurs, and an opening of the valve 17 is observed. Therefore, the purpose of the first series of jumps in richness produced is to determine the richness of the initial mixture (too rich or too lean), and to determine the amplitude of the measured variations in the valve position in order to determine the appropriate correction.

If the amplitude is above a threshold determined experimentally on a typical engine, a correction must be made. On the contrary, if the amplitude is lower than the threshold, the engine 10 is determined to be running at the optimal richness and no correction need be made.

The maps produced from a typical engine make it possible to simplify the work of the computer 19, which need only search for the average of the measured variations in order to determine the correction to be applied.

However, in a variant, the computer 19 can easily perform the necessary calculations, at each series of jumps in richness, in order to determine the correction to be applied.

It is noted that the plurality of jumps in richness is produced by injecting quantities of fuel different from the initial quantities supplied to the engine. Likewise, it is possible to obtain a plurality of jumps in richness by injecting quantities of air different from the initial quantities supplied to the engine.

FIG. 3 shows an engine equipped not only with a speed regulator 16, but also with an injection system 15'. In this case, there is no carburetor 12 and the valve 17 for the gasses is simply placed inside the intake manifold 20 of the engine 10. The carburetor 12 is replaced by the intake manifold 20 in which the mixture of the fuel and the air takes place.

The process for determining the optimal richness of the mixture supplied to the engine 10 according to the invention remains identical to the one explained in connection with FIG. 1. In the case of the engine 10, however, it is the injection time for the fuel that is modified and the correction maps therefore include correction values which correspond to fuel injection times.

The rest of the process described above in reference to FIG. 1 remains applicable. It must be noted that in the case of an engine 10 equipped with a speed regulator 16 and a fuel injection system 15', it is not necessary to add a position sensor for the valve 17, since this engine 10 already has one for calculating the injection time. It is also noted that adapting an engine 10 of this type to bring it into conformity with the new pollution standards is less costly.

It is understood that the present invention is not limited to the embodiments described above and encompasses all variants within the scope of one skilled in the art. Thus, instead of modifying the quantity of fuel supplied to the engine 10 in order to produce the jumps in richness, it is possible to modify the quantity of air admitted.

I claim:

1. A process for determining an optimal richness of a fuel-air mixture supplied to an internal combustion engine, which comprises:

providing an internal combustion engine having a speed regulator capable of varying an opening angle of a valve for admitting a fuel-air mixture into the internal combustion engine for maintaining the internal combustion engine at a constant rotational speed;

supplying an initial fuel-air mixture to the internal combustion engine;

regulating a rotational speed of the internal combustion engine by acting on a position of the valve controlling admittance of the initial fuel-air mixture by producing a plurality of jumps in richness of the initial fuel-air mixture supplied to the internal combustion engine for acting on the position of the valve;

measuring variations in the position of the valve corresponding to each of the jumps in richness in the initial fuel-air mixture;

deducing that when the variations in the position of the valve are lower than a threshold that the initial fuel-air mixture is at an optimal richness, and that when the variations in the position of the valve are higher than the threshold that the richness of the initial air-fuel mixture must be modified; and performing a correction of the richness of the initial fuel-air mixture supplied to the internal combustion engine if the threshold is exceeded which takes into account an amplitude of the measured variations in the position of the valve.

2. The determining process according to claim 1, which comprises producing the plurality of jumps in the richness by injecting quantities of fuel different from initial quantities supplied to the internal combustion engine.

3. The determining process according to claim 1, which comprises producing the plurality of jumps in the richness by injecting quantities of air different from initial quantities supplied to the internal combustion engine.

4. The determining process according to claim 1, which comprises producing three consecutive jumps in the richness, and averaging the measured variations in the position of the valve during the three jumps to determine a correction of the richness to be applied.

5. The determining process according to claim 1, which comprises providing a first table containing the correction to be applied to the initial fuel-air mixture if the initial fuel-air mixture is too lean for each average value of the valve opening angle and for each variation in an opening angle, and providing a second table for containing the correction to be applied to the initial fuel-air mixture when the initial fuel-air mixture is too rich for each average value of the valve opening angle and for each variation in the opening angle.

6. The determining process according to claim 5, which comprises providing the first table and the second table in a form of a stored map for each typical engine.

7. A device for determining an optimal richness of a fuel-air mixture, comprising:

means capable of imposing jumps in richness of an initial fuel-air mixture supplied to an engine having a valve;

means for measuring variations in a valve position of said valve;

computing means capable of determining the richness of the initial fuel-air mixture supplied to the engine; and means for determining a correction to be applied to the richness of the initial fuel-air mixture as a function of an initial position of said valve, an amplitude of the measured variations in said valve position and the richness of the initial fuel-air mixture.

8. The device according to claim 7, wherein said means capable of imposing jumps in the richness has a fuel delivery actuator.

9. The device according to claim 7, wherein said means for determining the correction to be applied has two maps which provide the correction to be applied as a function of the measured variations in said valve position, respectively when the initial fuel-air mixture is lean and when it is rich.

10. The device according to claim 7, wherein said means capable of imposing jumps includes an electronic fuel injection system and the correction to be applied is a variation of an injection time for fuel.

11. A device for determining an optimal richness of a fuel-air mixture, comprising:

a fuel delivery device capable of imposing jumps in richness of an initial fuel-air mixture supplied to an engine having a valve;

a sensor for measuring variations in a position of said valve;

a computing device capable of determining the richness of the initial fuel-air mixture supplied to the engine; and said computing device having a memory for determining a correction to be applied to the richness of the initial fuel-air mixture as a function of an initial position of said valve, an amplitude of the measured variations in said position of said valve and the richness of the initial fuel-air mixture.

* * * * *